United States Patent [19]

Kallianos et al.

[11] Patent Number: 4,998,542

[45] Date of Patent: Mar. 12, 1991

[54] WRAPPER FOR SMOKING ARTICLES AND METHOD FOR PREPARING SAME

[75] Inventors: Andrew G. Kallianos, Midlothian; A. Clifton Lilly, Jr., Chesterfield; Jerry F. Whidby, Richmond; Rowland W. Dwyer, Jr., Richmond, all of Va.

[73] Assignee: Philip Morris Incorporated, New York, N.Y.

[21] Appl. No.: 315,388

[22] Filed: Feb. 23, 1989

[51] Int. Cl.[5] ..... A24D 1/02

[52] U.S. Cl. ..... 131/365; 162/139

[58] Field of Search ..... 131/365; 162/139

[56] References Cited

U.S. PATENT DOCUMENTS

| | | |
|---|---|---|
| 2,915,475 | 12/1959 | Bugosh . |
| 3,759,683 | 9/1973 | Dislich et al. . |
| 3,847,583 | 11/1974 | Dislich et al. . |
| 4,044,778 | 8/1977 | Cohn . |
| 4,231,377 | 11/1980 | Cline et al. . |
| 4,433,697 | 2/1984 | Cline et al. . |
| 4,450,847 | 5/1984 | Owens . |
| 4,543,341 | 9/1985 | Barringer et al. . |
| 4,777,151 | 12/1988 | Koba et al. . |
| 4,798,815 | 1/1989 | Fain . |
| 4,806,428 | 2/1989 | Cooper et al. . |
| 4,881,557 | 11/1989 | Martin . |
| 4,915,117 | 4/1990 | Ito . |

FOREIGN PATENT DOCUMENTS

| | | |
|---|---|---|
| 213010 | 3/1987 | European Pat. Off. . |
| 281034 | 9/1988 | European Pat. Off. . |
| 286155 | 10/1988 | European Pat. Off. . |
| 294208 | 12/1988 | European Pat. Off. . |
| 2429783 | 1/1975 | Fed. Rep. of Germany ..... 131/365 |
| 60-60931 | 4/1985 | Japan . |
| 61-242627 | 10/1986 | Japan . |
| 62-4438 | 1/1987 | Japan . |
| 63-100050 | 5/1988 | Japan . |
| 63-166746 | 7/1988 | Japan . |
| 63-166747 | 7/1988 | Japan . |
| 63-195109 | 8/1988 | Japan . |
| 63-229146 | 9/1988 | Japan . |
| 2041913A | 9/1980 | United Kingdom . |
| 2191930 | 6/1987 | United Kingdom . |

OTHER PUBLICATIONS

"New Lightest Aerogel is Nothing to Look At", *Research News* (Feb. 16, 1990) 807.

N. P. Bansal, "Sol-Gel Synthesis of Magnesium Oxide-Silicon Dioxide Glass Compositions", 71 *J. Am. Ceramic Soc.* (Aug. 1988) 666-672.

J. D. Mackenzie, "Applications of the Sol-Gel Process", 100 *J. Non-Crystalline Solids* (1988) 162-168.

D. W. Schaefer, "Polymers, Fractals, and Ceramic Materials", 243 *Science* (Feb. 24, 1989) 1023-1027; and L. L. Hench & J. K. West, "The Sol-Gel Process", 90 *Chem. Rev.* (1990) 33-72.

E. Calvet, P. Boivinet, M. Noel, N. Thibon, A. Maillard, and R. Tertian, "Contribution a l'Etude des Gels d'Alumine", (5) 20 *Soc. Chim. de France Bull.* 99-108 (1953).

E. Barringer and H. K. Bowen, "Formation, Packing, and Sintering of Monodisperse $TiO_2$ Powders", 65 *J. Am. Ceramic Soc.* C-199 to C-201 (Dec. 1982).

D. Uhlmann, B. Zelinski, & G. Wnek, "The Ceramist as Chemist—Opportunities for New Materials", *Better Ceramics Through Chemistry*, 32 *Mats. Res. Soc. Symp. Proc.* 59-70 (C. J. Brinker, D. Clark and D. Ulrich, eds.; 1984).

J. Grassi, "Characterization of Parameters Affecting the Properties of an Alkoxide-Derived Zirconia Sol--Gel", Graduate School of Clemson University, Masters' Thesis, Aug. 1985.

K. Yamaguchi, T. Fujii, S. Kuranouchi, and A. Kaneko, "Fabrication of Transparent Iron-Oxide Films by Means of Sol-Gel Synthesis (Abstract)", *J. App. Physics* 64 (1988) 5452.

(List continued on next page.)

*Primary Examiner*—V. Millin

*Attorney, Agent, or Firm*—John M. Hintz

[57] ABSTRACT

A wrapper for smoking articles having controllable combustion characteristics. The wrapper comprises cigarette paper and an amorphous inorganic network formed from a gel.

24 Claims, 4 Drawing Sheets

OTHER PUBLICATIONS

B. E. Yoldas, "Zirconium Oxides Formed by Hydrolytic Condensation of Alkoxides and Parameters that Affect Their Morphology", *J. Mat. Sci.* 21 (1986) 1080–1086 (referred to herein as Yoldas (1986 I).

H. Dislich, "New Routes to Multicomponent Oxide Glasses", *Angew, Chem. Internat. Edit.* 10 (1971) 363–369.

J. B. Blum and S. R. Gurkovich, "Sol-Gel Derived $PbTiO_3$," *J. Mat. Sci.* 20 (1985) 4479–4483.

Y. Hayashi and J. B. Blum, "Sol-Gel Derived $PbTiO_3$—Part 2; Structural Control of Monolithic Gels", *J. Mat. Sci.* 22 (1987) 2655–2660.

J. C. Debsikdar, "Preparation of Transparent Non--Crystalline Stoichiometric Magnesium Aluminate Gel-Monolith by the Sol-Gel Process", *J. Mat. Sci.* 20 (1985) 4454–4458.

B. E. Yoldas, "Hydrolysis of Titanium Alkoxide and Effects of Hydrolytic Polycondensation Parameters", *J. Mat. Sci.* 21 (1986) 1087–1092 (referred to herein as Yoldas (1986 II)).

H. Yoshimatsu, H. Kawasaki, and A. Osaka, "Stability of Tetragonal $ZrO_2$ Phase in $Al_2O_3$Prepared from Zr-Al Organometallic Compounds", *J. Mat. Sci.* 23 (1988) 332–336.

Y. Takahashi and Y. Matsuoka, "Dip-Coating of $TiO_2$ Films Using a Sol Derived from $Ti(O\text{-}i\text{-}Pr)_4$-diethanolamine-$H_2O$-i-PrOH System", *J. Mat. Sci.* 23 (1988) 2259–2266.

P. A. Brugger and A. Mocellin, "Preparation of Composite $Al_2O_3$–$TiO_2$ Particles from Organometallic Precursors and Transformations During Heating", *J. Mat. Sci.* 21 (1986) 4431–4435.

A. Rousset, F. Chassagneux, and J. Paris, "Preparation and Properties of Active Submicronic Solids and New Metastable Phases Obtained via a Metal-Organic Precursor Method", *J. Mat. Sci.* 21 (1986) 3111–3115.

B. E. Yoldas, "Alumina Gels that Form Porous Transparent $Al_2O_3$," *J. Mat. Sci.* 10 (1975) 1856–1860.

J. B. Blum, "Sol-Gel Processing of Ceramics for Microelectronic Appliances", *Int'l J. for Hybrid Microelectronics* 8 (Sep. 1985) 1–5.

R. Roy, "Ceramics by the Solution-Sol-Gel Route", *Science* 238 (Dec. 18, 1987) 1664–1669.

H. Schmidt, "Chemistry of Material Preparation by the Sol-Gel Process", *J. Non-Cryst. Solids* 100 (1988) 51–64.

G. W. Scherer, "Aging and Drying of Gels", *J. Non--Cryst. Solids* 100 (1988) 77–92.

A. F. M. Leenaars, K. Kelzer, and A. J. Burggraaf, "Porous Alumina Membranes", *Chemtech* 16 (Sep. 1986) 560–564.

W. R. Cannon, "Ceramics, Advanced Structural Products", *Ullmann's Encyc. of Indus. Chem.* vol. A6 (1986) 43–53.

V. A. Greenhut and R. A. Haber, "Ceramics, Ceramic-Metal Systems", *Ullmann's Encyc. of Indus. Chem.* vol. A6 (1986) 55.

G. W. Phelps and J. B. Wachtman, Jr., "Ceramics, General Survey", *Ullmann's Encyc. of Indus. Chem.* vol. A6 (1986) 1–42.

WRAPPER FOR SMOKING ARTICLES AND METHOD FOR PREPARING SAME

BACKGROUND OF THE INVENTION

1. Field Of The Invention

The present invention relates to the manufacture of wrappers for smoking articles such as cigarettes. More particularly, this invention relates to the use of gels produced by a solution-gelation or "sol-gel" process for controlling the combustion of wrappers for smoking articles. In one embodiment, the gels made by this process are applied as coatings to paper fibers before the paper is formed into wrappers for smoking articles. The coated paper wrappers of this invention are useful in reducing or preventing combustion of the wrappers of smoking articles. The wrappers are also useful in controlling the mass burn rate of cigarettes.

2. Description Of Related Art

One problem with smoking articles such as cigarettes is the amount of sidestream smoke generated during burning. Sidestream smoke is the smoke generated by cigarettes when they are burning but not being drawn upon by the smoker, as when a cigarette is placed in an ashtray between puffs. Sidestream smoke may be objectionable to non-smokers.

Efforts have been made to reduce the amount of sidestream smoke generated by cigarettes. While these methods may reduce the amount of sidestream smoke, they do not provide the smoker with a cigarette that looks, feels, and tastes the same as conventional cigarettes.

U.S. Pat. No. 4,231,377 to Cline et al. ("Cline I") refers to a method of reducing sidestream smoke by applying a specified amount of magnesium oxide or magnesium hydroxide in combination with specific chemical "adjuvants" to paper fibers as a filler or coating. The magnesium salts are applied as a solution. However, according to U.S. Pat. No. 4,433,697 to Cline et al. ("Cline II"), the ash generated by burning cigarettes made from paper prepared according to the method of Cline I is unacceptable because of its flakiness. Cline II proposes to reduce the flakiness of the ash by adding ceramic fibers to the paper-making slurry. The method of Cline II is problematic because of the substantial cost of the ceramic fibers. A further shortcoming of the proposal of Cline II is that ceramic fibers must be added to the paper-making slurry; commercially available cigarette papers cannot be modified according to the proposal after their manufacture.

U.S. Pat. No. 4,450,847 to Owens refers to the use of fine particle size magnesium hydroxide gel in place of the magnesium hydroxide referred to in Cline I and II. Although Owens characterizes his magnesium hydroxide as a gel, he states that the gel is actually "an apparently homogeneous substance or a dispersion consisting of an aggregate of very small particles in very close association with a liquid, and the gel at the concentrations used in this invention is actually broken into flocs floating in the aqueous medium." (Col. 3, lines 62–68). Owens' magnesium hydroxide gel is said to be used with magnesium oxide or calcium carbonate and a suitable chemical "adjuvant" as in Cline I and II.

Hampl et al., U.K. Patent Application GB 2 191 930 A, refers to cigarette papers that have been formed with high superficial surface area fillers. These cigarette papers are stated to yield reduced sidestream smoke when used as wrappers for cigarettes. Fillers such as attapulgite clay, fumed or activated alumina, chalk, fumed silica, and peroxides of magnesium, calcium, and strontium are said to be useful. Other fillers such as the carbonates, phosphates, sulphates, aluminates, and silicates of certain metals are also said to be useful as long as their superficial surface area exceeds 20 $m^2/g$. Hampl et al's method also requires the use of potassium or sodium salts of various acids to maintain the integrity of the cigarette ash.

Apart from the problems already noted, the modified wrappers of Cline I and II, Owens, and Hampl et al. all suffer from a serious disadvantage —the smoking of cigarettes made from paper containing magnesium oxide or magnesium hydroxide produces an off taste. It is believed that this taste arises from the strongly alkaline nature of the magnesium and from the other chemicals used.

In addition, the size of the particles employed by Cline I and II, Owens, or Hampl is critical. If the particles are too small, they will be dislodged from the wrapper, creating an objectionable dust. If they are too large, they will obstruct the porosity of the wrapper, interfering with the combustion of the tobacco fuel rod.

Accordingly it is an object of this invention to provide a wrapper for smoking articles which reduces or prevents combustion of the wrappers of smoking articles and which may be incorporated into a smoking article which has the look, feel, and taste of conventional smoking articles.

SUMMARY OF THE INVENTION

The present invention solves the problems associated with prior art wrappers for smoking articles by providing a wrapper with desireable combustion characteristics, yet which may be incorporated into smoking articles that have the look, feel, and taste of conventional cigarettes. The present invention employs sol-gel processes to form a film of metal oxides that may be applied as a coating on cigarette paper to produce the desired combustion and subjective characteristics.

A sol-gel process is a soft chemical method of preparative solid state chemistry. The product of the process is an amorphous inorganic network. See generally R. Roy, "Ceramics By The Solution-Sol-Gel-Route," *Science*, 238, pp. 1664–69 (1987) and H. Schmidt, "Chemistry Of Material Preparation By The Sol-Gel Process," *J. Non-Crystalline Solids*, 100, pp. 51–64 (1988).

In one embodiment of this invention, a sol-gel process is used to produce a gel of selected metal oxides that is applied as a film upon the surface of fibers of conventional cigarette paper. In a further embodiment, at least one annular band of a gel formed by a sol-gel process according to this invention is applied to the surface of a cigarette in order to produce a cigarette whose mass burn rate will approach zero when allowed to idle for a predetermined amount of time. Preferably, a plurality of discrete bands, each of which substantially circumscribes the periphery of a smoking article, are present. And in a yet further embodiment, the wrapper of a novel smoking article described in copending U.S. application Ser. No. 07/223,153, filed July 11, 1988, which is incorporated herein by reference (hereinafter, "novel smoking article"), is modified with the gels made as described herein in order to prevent combustion of the wrapper of this novel smoking article.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
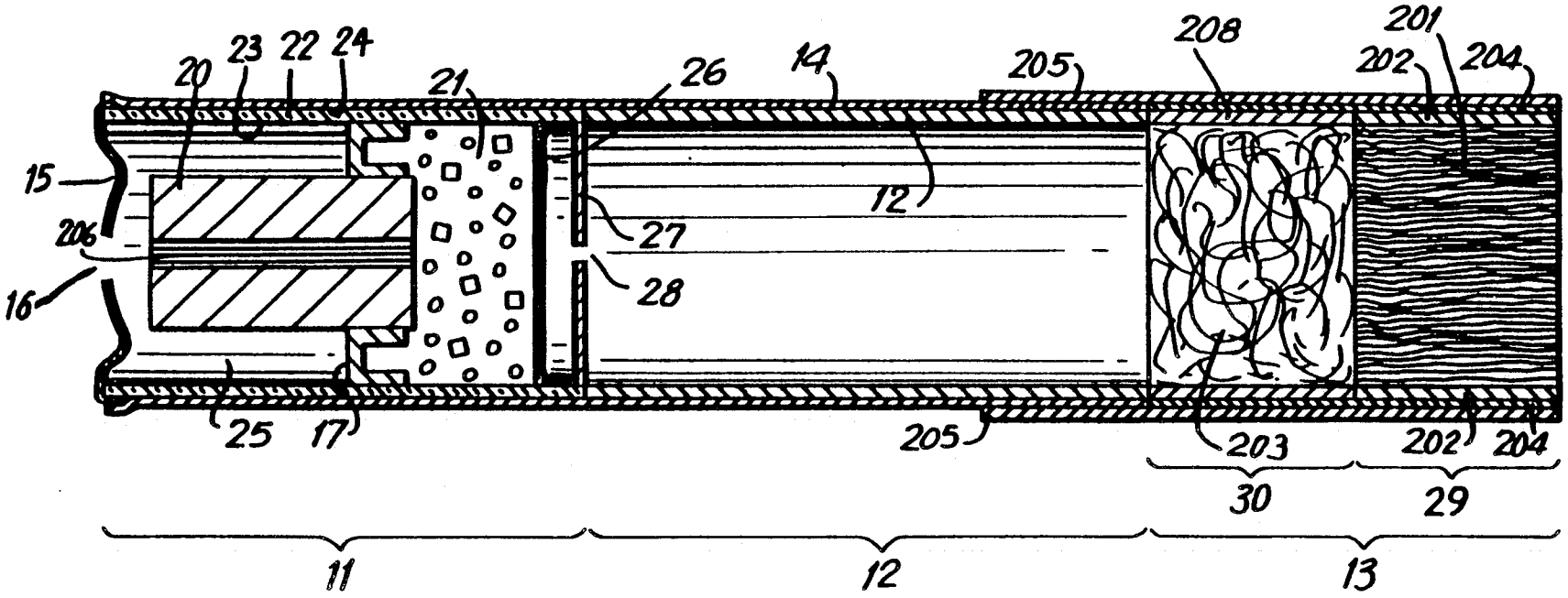
FIG. 1 is a longitudinal cross-sectional view of a novel smoking article.

The sol-gel process permits synthesis of homogeneous gels of metal oxides. When dried after application to wrappers for smoking articles, these gels form films. Because dried films produced by a sol-gel process reduce the propensity of smoking articles to burn, they may be employed to produce self-extinguishing cigarettes and to substantially eliminate flaming combustion of novel smoking articles.

The sol-gel process generally consists of the following steps: preparation of a solution of a precursor of a metal oxide, hydrolysis, condensation or gelling, formation, and drying. R. Roy, "Ceramics By The Solution-Sol-Gel Route," *Science*, 238, pp. 1664, 1669, 1665 (1987). The state of the gel resulting from the condensation step is determined by the extent of hydrolysis and formation. Thus, the specific morphology of the product of the sol-gel process may be controlled by adjusting the concentration of the reactants, temperature, and pH during the hydrolysis and condensation steps.

The process for preparing the films of the present invention begins with the selection of suitable metal oxide precursors. It is preferred that these substances are metal alkoxides. In addition to alkoxides, other precursors such as metallic borate and silicate salts, or alternately, organic or inorganic salts or complexes may be employed as metal oxide precursors.

While the alkoxides of almost every metal in the periodic table have been prepared, the preferred starting materials are alkoxides of aluminum, calcium, titanium, magnesium, and zirconium. In alternative embodiments, the alkoxides of sodium and potassium may be used, but it is preferred that they be mixed with alkoxides of other metals. When the desired film is magnesium oxide, it is preferred to form a solution for the sol-gel process from a combination of a magnesium alkoxide and an aluminum, titanium, or zirconium alkoxide. The most preferred films comprise oxides of calcium, aluminum, and mixtures of aluminum and magnesium, mixtures of calcium and aluminum, and mixtures of calcium, magnesium, or aluminum with zirconium.

Water and a suitable acid are added to the metal alkoxide, for example, aluminum alkoxide and preferably aluminum-sec-butoxide, to initiate hydrolysis while the mixture is stirred.* Hydrolysis may also be initiated by the addition of bases, although the use of acids is preferred. The acid may an organic or an inorganic acid. Inorganic acids, including hydrochloric, phosphoric, and nitric are preferred. Hydrochloric acid is particularly preferred. Organic acids, such as acetic, succinic, and citric acids are also within the scope of this invention. Increasing acidity or basicity as well as increasing the temperature cause the hydrolysis reactions to occur more rapidly. Moderate conditions are preferred, as the reaction is then easier to control. In commercial embodiments of this invention, it is preferred to conduct this part of the sol-gel process in an inert atmosphere, such as under a blanket or stream of nitrogen.

After hydrolysis, the mixture is heated and continually stirred to initiate condensation. The addition of an acid or a neutral salt facilitates the condensation and affects the viscosity of the resulting gel. The acid may be any of the acids used in the hydrolysis step. The neutral salt may be potassium acetate, potassium chloride, sodium chloride, or sodium phosphate. Preferably, gels have a concentration of metal oxides of about 12% and a viscosity of about 5 to 20 centipoise after completion of the gelation step. The most preferred gels have a metal oxide concentration of about 16 to 18% with attendant increases in viscosity.

After the desired degree of gelation has occurred, the mixture is allowed to cool. The resulting gel, in diluted or undiluted form, is applied as a film to paper fibers for use in cigarette wrappers. Gels may be applied by any of a variety of techniques known in the art. Preferably, the gels are applied to wrappers using a size press, rotogravure press, or blade coater, although they may also be applied by hand. Following application of the gel to paper, the gel is dried to form a film upon the paper. Preferably the gel is dried at a temperature of 100° to 150° C. The method of drying may be by any known method such as by contact with a heated surface.

When used as wrappers for smoking articles, papers modified by the application of the gels of the present invention have superior burn characteristics when compared with untreated papers. These improvements include reduced incidence of flaming combustion and, if desired, complete elimination of combustion. Although not intending to be bound by theory, it is believed that during the combustion of gel-coated papers, the ceramics collapse to form a sheath around the paper and tobacco ash at the end of the smoking article. This sheath maintains its structural integrity because of the strength imparted by the cross-linked structure of the dried sol-gel film. The thickness, uniformity in coverage, and porosity of the sheath, in both the radial and longitudinal directions, determines the resulting burn characteristics of the smoking article.

In one embodiment of this invention, a cigarette is manufactured according to methods well known in the art, except that a wrapper is formed from cigarette paper to which a thin and continuous coating of the gels of this invention has been applied. This coating may be applied to cigarette paper before cigarettes are manufactured by using, for example, size presses, rotogravure presses, or blade coaters.

In another embodiment of this invention, an annular coating of the gels of this invention is applied to the paper fibers of the wrapper of a cigarette in at least one separate ring disposed perpendicularly to the longitudinal axis of a cigarette. This produces a cigarette that will cease burning if not actively smoked, i.e., drawn upon by the smoker, for a predetermined amount of time. Preferably, a plurality of discrete bands, each of which substantially circumscribes the periphery of a smoking article, are employed. This coating is preferably applied in the form of a gel which is subsequently dried to form a film upon the paper. The gel may be applied directly to cigarettes or it may be applied to cigarette paper, with a size press, rotogravure press, or a blade coater, which is then used to manufacture cigarettes. Such treatment results in a cigarette that will have a mass burn rate approaching zero if allowed to idle as when it is placed in an ashtray between puffs. The time required for a cigarette made according to this embodiment to approach zero mass burn rate varies with the location and thickness of the film applied to the paper fibers.

In yet another embodiment of this invention, a smoking article of the type described in copending U.S. application Ser. No. 07/223,153, filed July 11, 1988, and incorporated herein by reference (hereinafter "novel smoking article"), is prepared using cigarette paper manufactured in accordance with this invention. Alternatively, a 10 mm wide annulus of the gels of the present invention is applied about 8 mm from a distal or lighting end of such novel smoking articles. After the gel is dried, the resulting film protects the wrappers of these smoking articles from thermal damage including charring and flaming combustion.

As shown in FIG. 1, novel smoking articles consist of a mouth end 13, a spacer element 12, and an active element 11 at a distal end remote from the mouth end. The active element 11 is in fluid communication with the mouth end 13. The active element 11 includes a heat reflective substantially hollow sleeve 22 having an internal wall 23 and an external wall 24 and having a first end at the distal end and a second end closer to the mouth end. A reflective end cap 15 may be clipped over the external wall 24 of sleeve 22 at the first end of the sleeve. Cap 15 has one or more orifices or perforations 16 which allow air into active element 11. Disk 27 may be provided at the second end of sleeve 22 to close off active element 11 from spacer element 12 while still allowing fluid communication through orifice 28.

A substantially cylindrical carbon-containing heat source 20 is inserted in sleeve 22 adjacent the first end of the sleeve. Preferably, sleeve 22 is fitted with one or more metallic clips 17 which hold heat source 20 suspended away from internal wall 23 of sleeve 22, defining an annular space 25 around the heat source. The heat source 20 has a fluid passage 206 substantially through the center thereof.

A flavor bed 21 is held within sleeve 22 between clip 17 and heat source 20 on one end and a screen-like clip 26, which holds pellets of flavor bed 21 while allowing air passage, on the other end. Flavor bed 21 is in radiative and convective heat transfer relationship with heat source 20. Active element 11 and spacer element 12 are jointly wrapped in an abutting relationship by wrapper 14.

Mouth end 13 may include a filter segment 29 and a tobacco rod segment 30. Filter segment 29 may be a cellulose acetate filter plug 201 wrapped in plug wrap 202. Tobacco rod segment 30 may be tobacco filler 203 wrapped in plug wrap 208. Filter segment 29 and tobacco rod segment 30 are jointly overwrapped in an abutting relationship by plug wrap 204. Mouth end 13 is jointly overwrapped with spacer element 12, which is jointly overwrapped with active element 11, in an abutting relationship by tipping paper 205.

When the heat source is ignited and air is drawn through the smoking article, air is heated as it passes through the fluid passage. The heated air flows through the flavor bed causing the release of a flavored aerosol which the heated air then carries to the mouth end.

The following examples present specific methods of preparation and uses of the gels of the present invention. These examples and the particular methods of use described should be read as being illustrations of, rather than limitations on, the present invention.

EXAMPLE I

Preparation Of Aluminum Oxide Gels With Acetic Acid

Approximately 240 g (1 mole) of aluminum sec-butoxide was mixed with 3 L of distilled water containing 50 ml of 1N acetic acid (0.05 moles). The mixture was divided into two equal portions, and each portion was brought to a boil. Constant stirring using a magnetic stirring hot plate, at a rate sufficient to produce a vortex at the surface of the mixture, was maintained throughout the process and for an additional 1.5 hours. A 10 ml volume of a solution containing 0.486 g of potassium acetate dissolved in 20 ml of distilled water was added to one portion of the mixture. The potassium acetate solution was added dropwise over a period of 1 hour. After an additional 0.5 hours, boiling of both mixtures was stopped. The two mixtures were then combined and this combined mixture was brought to a temperature of 80° C.

EXAMPLE II

Coating Papers With Gels Prepared By The Sol-Gel Process

Commercial grade calcium carbonate filled cigarette papers (TOD 04242 obtained from Ecusta, a division of P.H. Glatfelter Co., P.0. Box 200, Pisgah Forest, NC 28768) were coated with the gel of Example I. The gels were maintained at a temperature of 80° C. throughout the coating operation. Hand sheets of cigarette paper were dipped into the gel and the excess gel was allowed to drip from the paper. The papers were dried in a microwave oven (Sharp Carousel, 650 Watts total power at medium low setting) to form a film. The papers were then handpressed with an iron to remove wrinkles.

EXAMPLE III

Coating Papers With Gels Prepared By The Sol-Gel Process

Commercial grade cigarette papers (TOD 04242 obtained from Ecusta) were coated with gels prepared according to Example I in a single pass through a size press applicator. The coating produced a weight gain of 3.5 to 4.0%. The coated paper was dried in a microwave oven as in Example II.

EXAMPLE IV

Testing Of Smoking Articles Made With Aluminum Oxide Gel Treated Wrappers

Novel smoking articles were made with wrappers of paper coated as described in Examples II and III. The novel smoking articles were then tested on a single port smoking machine using a 70 cc puff every 15 seconds. Each article was lit and 4 puffs were taken by the smoking machine to achieve a normal smoking temperature within the article before actual testing commenced.

Three tests were then conducted to determine the combustion of the outer paper wrapper. First, a lighter flame was brought to within about 1 mm of the distal of the novel smoking article during static burn. Second, a lighter flame was held directly under the distal end of the novel smoking article during static burn. Third, a lighter flame was brought under the distal end of the novel smoking article during a puff to simulate lighting of an already lit article.

When novel smoking articles made with wrappers treated with the gels of Example I were tested as described here, it was observed that whether the gels were applied by dipping (Example II) or with a size press (Example III) the wrappers substantially resisted combustion.

EXAMPLE V

Preparation Of Aluminum Oxide Gels With Hydrochloric Acid

This preparation was similar to that of Example I except that hydrochloric acid was used. Approximately 240 g (1 mole) of aluminum sec-butoxide was mixed with 3 L of distilled water containing 30 ml (0.03 moles) of 1N hydrochloric acid. The mixture was then heated with constant stirring as in Example I until complete solution was obtained. The mixture was then divided into two equal portions. Each portion was placed on a magnetic stirring hot plate and brought rapidly to a temperature of 95° C. Constant stirring and temperature were maintained for an additional 1.5 hours. After this time, 60 ml (0.06 moles) of 1N hydrochloric acid was added to each portion. The temperature of the solution was maintained at 95° C. and stirring continued for an additional 1.5 hours. The two mixtures were then combined and this mixture was brought to a temperature of 80° C.

EXAMPLE VI

Evaluation Of Wrappers Treated With Aluminum Oxide Gels

A film of the gel of Example V was deposited on the fibers of commercial grade calcium carbonate filled cigarette papers as described in Examples II and III and novel smoking articles were prepared from them. The tests described in Example IV were performed on the novel smoking articles. In all three test situations, whether gels were applied by dipping (as in Example II) or with a size press (as in Example III) paper wrappers treated with the gel prepared by Example V resisted flaming combustion.

EXAMPLE VII

Preparation Of Dilute Aluminum Oxide Gels And Application To Cigarette Paper In a nitrogen atmosphere, approximately 52 g (0.2 moles) of aluminum tri-sec-butoxide was mixed with 600 ml of distilled water containing 6 ml (0.006 moles) of 1N hydrochloric acid. The solution was placed on a magnetic stirring hot plate, and the solution was rapidly brought to a boil with constant stirring as in Example I. Boiling and stirring continued for approximately 1 hour. Then 32 ml of 1N hydrochloric acid (0.032 moles) was added to the solution. Boiling and stirring continued for an additional 5 minutes. At this time, the gel was divided into two equal portions.

One portion of the gel was retained as a source for concentrated gel. The other portion of the gel prepared from this procedure was diluted in a 50:50 ratio with distilled water. The gel of this Example was applied to cigarette paper as described in Example II.

A second dilution of the gel was prepared by adding 50 ml of concentrated gel to 15 ml of distilled water. The same paper sample was dipped into this diluted gel and dried as in Example II. Finally, the same paper sample was dipped in the concentrated gel solution and dried as before. The paper was then hand-pressed with an iron to remove wrinkles.

EXAMPLE VIII

Preparation Of Magnesium Aluminate Gels And Treatment Of Cellulose Fibers

Approximately 120 g (0.5 moles) of aluminum sec-butoxide was mixed with 1.5 L of distilled water containing 15 ml (0.015 moles) of 1N hydrochloric acid. The mixture was brought to a boil and continuously stirred as in Example I. Boiling and stirring continued until the mixture was reduced to a volume of approximately 870 ml. The mixture was then divided into one aliquot of 150 ml and six aliquots of 120 ml each.

One of the 120 ml aliquots was heated to a boil and then 3.8 g (0.033 moles) of magnesium ethoxide was added with stirring. After complete dissolution of the magnesium ethoxide, sufficient distilled water was added to bring the volume of the solution to 350 ml and then 12 ml (0.012 moles) of 1N hydrochloric acid was added. The pH of this solution was about 12 and considerable foaming was present. Concentrated hydrochloric acid (approximately 12N) was added dropwise until the pH reached about 4. The volume of concentrated hydrochloric acid added was approximately 8 ml.

The gel of this Example was applied to commercial cigarette paper according to Example II and formed into a hollow tube for testing of its burn characteristics. The cigarette paper coated with the gel prepared as described in this Example resisted combustion when ignition with an open flame was attempted.

EXAMPLE IX

Preparation Of Calcium Aluminate Gel

A solution of calcium ethoxide was prepared by reacting metallic calcium with absolute ethanol while heating the solution in a nitrogen atmosphere. A sample of 24.6 g of aluminum-sec-butoxide (0.1 moles) was mixed with 50 ml (0.05 moles) of a 1M solution of calcium ethoxide in absolute ethanol.

After combining the calcium ethoxide and aluminum sec-butoxide, the mixture was stirred and allowed to stand for 48 hours. Needle shaped crystals were observed on the bottom of the reaction vessel. The supernatant was decanted and the crystals were washed with absolute ethanol. Upon standing, the crystals were observed to disappear and the solution took on the consistency of a gel. Sufficient hydrochloric acid (1N) was added to the gel to reduce the pH from 12 to 8.

Upon standing, the supernatant separated into a buff colored alcoholic layer and a cloudy colloidal layer. One ml of the alcoholic layer was added to 0.1 ml of 0.09N hydrochloric acid to form a transparent gel. This gel was rinsed quickly with 2 ml of distilled water and dried in an oven at about 150° C. The resulting white powder was applied to carbon support grids for elemental analysis using a scanning and transmission electron microscope. Strong calcium and aluminum signals were present. It is believed that the gel prepared in this Example consists of an amorphous network of calcium aluminate ($CaAl_2O_4$). Preliminary experiments indicate that flax paper dipped into the gels of this Example resist combustion.

EXAMPLE X

Preparation Of Titania Gel 17.52 ml (0.3 moles) of absolute ethanol was added to a 50 ml beaker. The beaker was placed in an ice bath. A stream of nitrogen gas was directed into the beaker. While stirring vigorously with a magnetic stirrer, 11.16 ml (0.1 moles) of titanyl tetrachloride was added dropwise to the beaker. After the addition was complete, the beaker was removed from the ice bath. The mixture was stirred for an additional 2 hours. At this time, the mixture was stored for later use.

EXAMPLE XI

Coating And Evaluation Of Papers With Gels Prepared By The Sol-Gel Process

Approximately 0.6 g of the gel of Example XI, which had solidified, was dissolved in 25 ml of 70% ethanol. Samples of commercial grade flax cigarette paper were coated by dipping as described in Example II. One sample was dipped once and allowed to dry. Another sample was dipped once, allowed to dry, dipped again, and allowed to dry. A third sample was dipped twice and then dried in a microwave oven as described in Example II. Scanning electron micrographs revealed that the gel of Example XI produced a uniform coating over the surface of the dipped papers.

EXAMPLE XII

Preparation of Zirconia Gels 32.72 g (0.1 moles) of zirconium isopropoxide was dissolved in 200 ml of isopropanol. While stirring with a magnetic stirring hot plate, approximately 108.5 ml of isopropanol containing 8 ml of glacial acetic acid and 3.6 ml of distilled water was added. The mixture was then heated with constant stirring as in Example I. A gel formed within 5 minutes.

EXAMPLE XIII

Preparation Of Aluminum Oxide Gel With Hydrochloric Acid 15 ml of 1N hydrochloric acid was added to 1500 ml of distilled water. The acid and water mixture was heated to 70° C. Approximately 120 g (0.5 moles) of aluminum sec-butoxide was then added. This mixture was heated to 95° C. with stirring. The temperature of the solution was maintained at 95° C. and stirring continued until all of the sec-butanol evaporated. This took approximately 2 hours. At this time, 30 ml (0.03 moles) of 1N hydrochloric acid was added. The temperature was maintained and stirring continued until a final volume of 400 ml was obtained.

EXAMPLE XIV

Preparation Of Aluminum Oxide Gel With Hydrochloric Acid

Approximately 240 g (1 mole) of aluminum-sec-butoxide was mixed with 1600 ml of water containing 30 ml (0.03 moles) of 1N hydrochloric acid, which had been heated to 70° C. prior to mixing. The mixture was brought rapidly to 95° C. with continuous stirring and kept at that temperature for approximately 2.5 hours. At the end of that period of time, 60 ml of 1N hydrochloric acid was added to the mixture. The temperature of the solution was maintained and stirring continued until a final volume of 500 ml was obtained.

EXAMPLE XV

Reduction Of Mass Burn Rate

Figure 3:
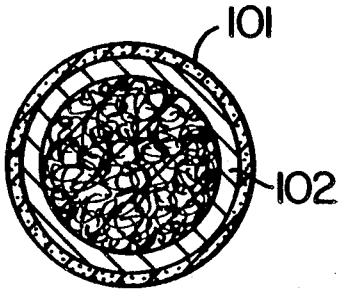
FIG. 3 is a radial cross-sectional view of the cigarette of FIG. 2, taken from line 3—3 of FIG. 2.
Figure 2:
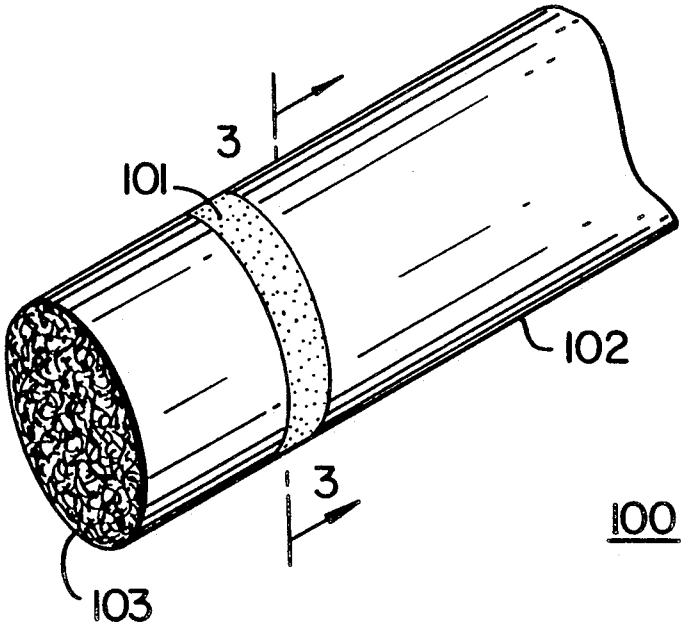
FIG. 2 is a perspective view of a cigarette showing an annulus of a gel of the present invention which has been applied to the wrapper.

Conventional cigarettes were treated with gel prepared according to Example XIV. As shown in FIGS. 2 and 3, cigarette 100 was coated with an annulus of gel 101. The annulus of gel 101 was applied to the wrapper 102 of cigarette 100 by hand with a brush. The center of the annulus was placed 32.5 mm from the lighting end 103 of cigarette 100. One set of cigarettes was coated with an annulus 4 mm wide; another set of cigarettes was coated with an annulus 5 mm wide. The width of each annulus was measured parallel to the longitudinal axis of the cigarette. The coated cigarettes were dried in air until the gels formed films on the cigarettes.

Figure 4:
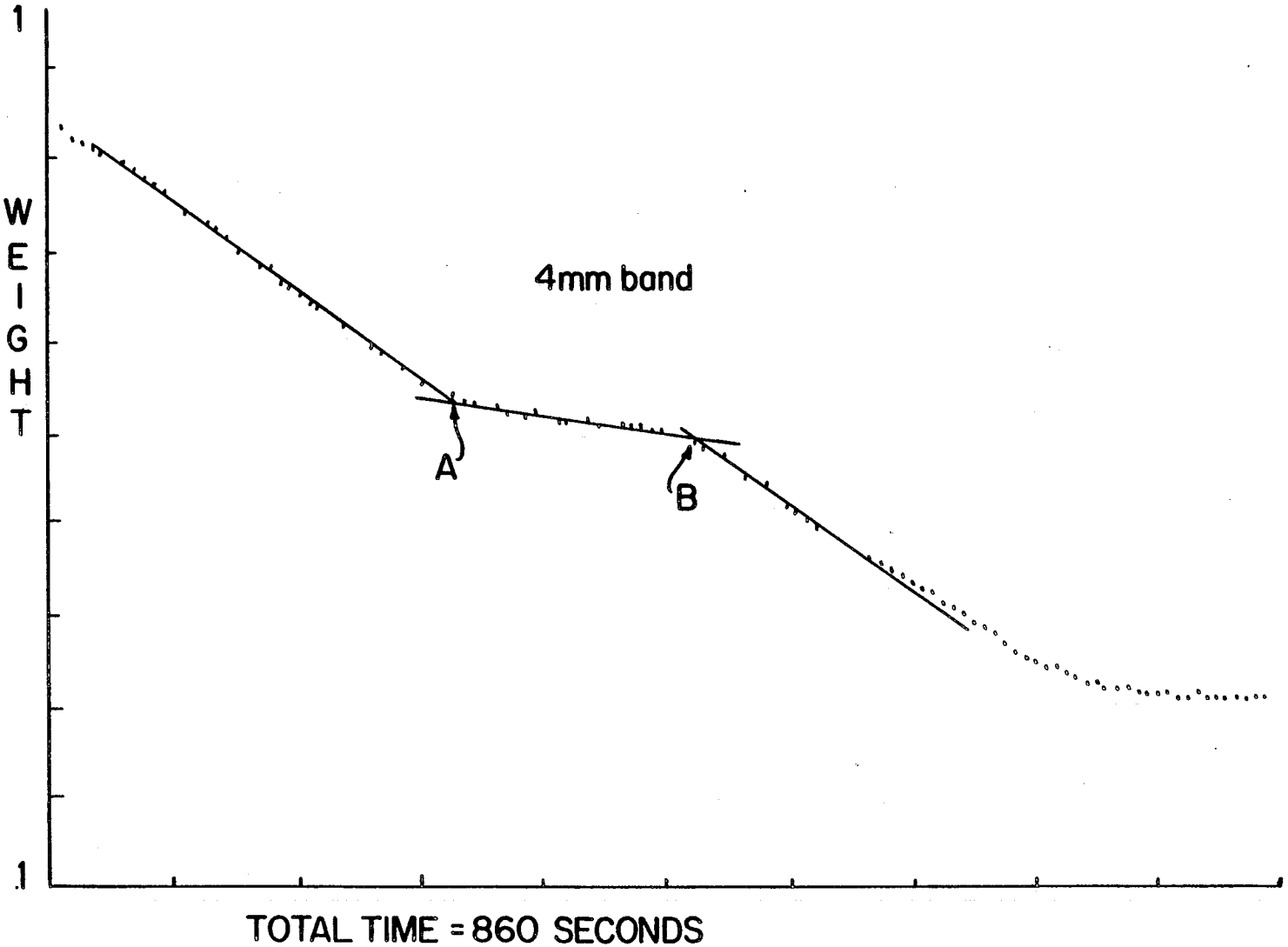
FIGS. 4 and 5 are graphs of the mass burn rates of cigarettes made with wrappers to which an annulus of a gel of the present invention has been applied.
Figure 5:
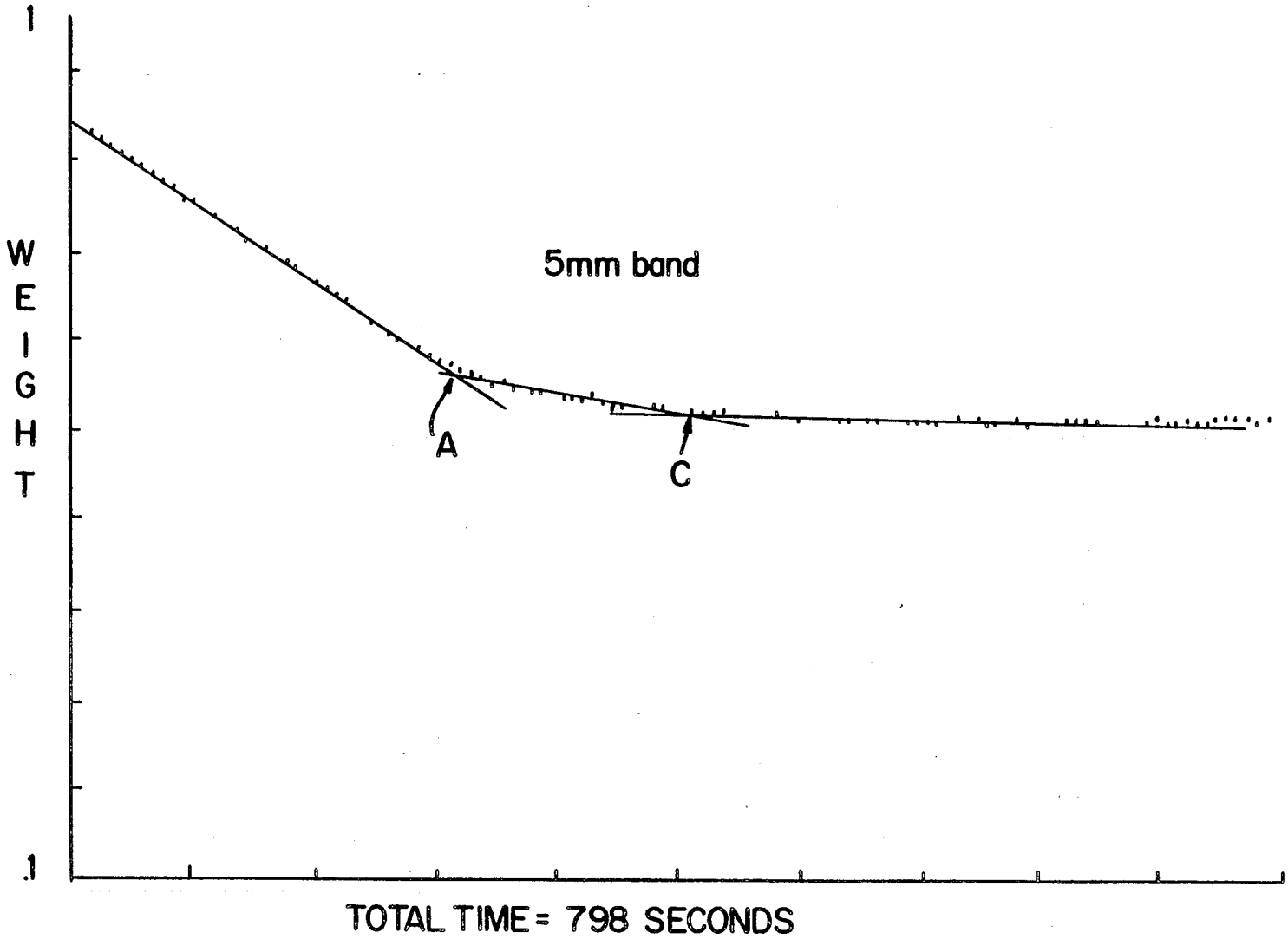

Cigarettes from each set were then individually tested by lighting a cigarette and placing it on a pan balance. The change in the weight of the burning cigarette was measured over time. FIGS. 4 and 5 illustrate the change in the weight of one cigarette from each set against time. FIG. 4 shows the result when a 4 mm band of gel was applied; FIG. 5 shows the result when a 5 mm band of gel was applied.

The slope of the lines in FIGS. 4 and 5 represent the mass burn rate of the cigarette, that is, how much weight is lost during a given burn time. The negatively sloping mass burn rate beginning at time equal to 0 seconds, shown in FIGS. 4 and 5, illustrate that both cigarettes experience constant weight loss after lighting. However, the mass burn rate decreases when the burning coal reaches the film annulus on the cigarette wrapper. This point is marked as "A" in both figures. In FIG. 4, this change occurred after approximately 197 seconds. In FIG. 5, this change occurred after approximately 263 seconds. This change in slope illustrates that the annulus of film inhibits the combustion of the cigarette.

As shown in FIG. 4 at point "B" (at approximately 455 seconds), after the cigarette has burned through the annulus of film, the mass burn rate again increases. However, as shown in FIG. 5 at point "C" (at approximately 417 seconds), the mass burn rate declines to zero indicating that the cigarette has extinguished. The affect of different widths of films is thus evident from a comparison of the mass burn rate lines. With a 4 mm wide film annulus, the cigarette remains lit after the burning coal has burned through the full width of the film annulus. However, with a 5 mm wide film annulus, the cigarette ceases burning after the burning coal reaches the film annulus but before burning through the annulus.

We claim:

1. A wrapper for smoking articles comprising paper fibers and an amorphous inorganic network produced by a sol-gel process applied thereto.

2. The wrapper for smoking articles of claim 1, wherein the amorphous inorganic network produced by a sol-gel process is formed from at least one metal oxide precursor.

3. The wrapper for smoking articles of claim 2, wherein the metal of the metal oxide precursor is selected from the group of metals consisting of: aluminum, titanium, zirconium, sodium, potassium, and calcium.

4. The wrapper for smoking articles of claim 2, wherein the metal oxide precursor is a magnesium compound.

5. The wrapper for smoking articles of claim 1, wherein the amorphous inorganic network produced by a sol-gel process is applied as a film.

6. The wrapper for smoking articles of claim 1, wherein the sol-gel process that produces an amorphous inorganic network produced by a sol-gel process comprises the steps of:

(a) forming a solution of at least one metal oxide precursor;

(b) hydrolyzing the metal oxide precursor in order to form a sol;

(c) condensing the sol to form a gel; and (d) drying the gel.

7. The wrapper for smoking articles of claim 6, wherein the step of condensing further comprises the step of decreasing the pH of the sol by the addition of acid.

8. The wrapper for smoking articles of claim 6, wherein the step of condensing further comprises the addition of a neutral salt.

9. A wrapper for controlling the mass burn rate of a cigarette comprising a paper wrapper and at least one annular band of an amorphous inorganic network.

10. A wrapper for controlling the mass burn rate of a cigarette comprising a paper wrapper and at least one annular band of a film produced according to any of claims 1 through 8.

11. A wrapper for a novel smoking article that resists combustion comprising a paper wrapper and an amorphous inorganic network.

12. A wrapper for a novel smoking article that resists combustion comprising the wrapper for smoking articles according to any of claims 1 through 8.

13. A method of altering the burn characteristics of a paper wrapper for smoking articles comprising:

(a) creating a gel of at least one metal by a sol-gel process;

(b) applying the gel to paper fibers; and (c) drying the gel upon the paper fibers.

14. The method of altering the burn characteristics of a paper wrapper for smoking articles of claim 13, wherein the step of creating further comprises:

(a) forming a solution comprising at least one metal oxide precursor;

(b) converting the solution into a sol by hydrolysis; and (c) condensing the sol to form a gel.

15. The method of altering the burn characteristics of a paper wrapper for smoking articles of claim 14 wherein the metal oxide precursor comprises a metal alkoxide.

16. The method of altering the burn characteristics of a paper wrapper for smoking articles of claim 14, wherein hydrolysis is effected by the addition of acid to the solution.

17. The method of altering the burn characteristics of a paper wrapper for smoking articles of claim 16, wherein the acid is selected from the group consisting of hydrochloric acid, acetic acid, citric acid, succinic acid, phosphoric acid, and nitric acid.

18. The method of altering the burn characteristics of a paper wrapper for smoking articles of claim 14, wherein the step of condensing also includes the addition of a neutral salt to the solution.

19. The method of altering the burn characteristics of a paper wrapper for smoking articles of claim 18, wherein the neutral salt is selected from the group consisting of potassium acetate, potassium chloride, sodium chloride, and sodium phosphate.

20. The method for altering the burn characteristics of a paper wrapper for smoking articles of claim 14, wherein the gel comprises aluminum oxide.

21. The method for altering the burn characteristics of a paper wrapper for smoking articles of claim 14, wherein the gel comprises magnesium aluminate.

22. The method for altering the combustion characteristics of a paper wrapper for smoking articles of claim 14 wherein the gel comprises calcium aluminate.

23. A wrapper for smoking articles comprising paper fibers and an amorphous inorganic network containing a metal oxide selected from the group consisting of: aluminum oxide, zironium oxide, titanium oxide, calcium oxide, magnesium aluminate, and calcium aluminate.

24. A wrapper for a smoking article comprising a wrapper and an amorphous inorganic network.

* * * * *

UNITED STATES PATENT AND TRADEMARK OFFICE

CERTIFICATE OF CORRECTION

PATENT NO. : 4,998,542

DATED : March 12, 1991

INVENTOR(S) : Kallianos et al.

It is certified that error appears in the above-identified patent and that said Letters Patent is hereby corrected as shown below:

Col. 9, line 22, delete "Example XI" and insert -- Example X --.

Col. 9, line 31, delete "Example XI" and insert -- Example X --.

Claim 23, col. 12, line 40, delete "zironium" and insert -- zirconium --.

Signed and Sealed this

Twenty-second Day of September, 1992

*Attest:*

DOUGLAS B. COMER

*Attesting Officer*

*Acting Commissioner of Patents and Trademarks*